US010060377B2

(12) United States Patent
Winkler et al.

(10) Patent No.: US 10,060,377 B2
(45) Date of Patent: Aug. 28, 2018

(54) METHOD FOR DETERMINING AN IMBALANCE OF AT LEAST ONE CYLINDER

(71) Applicant: Robert Bosch GmbH, Stuttgart (DE)

(72) Inventors: Klaus Winkler, Rutesheim (DE); Henrico Runge, Farmington Hills, MI (US); Benjamin Sillmann, Stuttgart (DE); Hartwig Lehle, Stuttgart (DE); Eduard Weiss, Untergruppenbach (DE)

(73) Assignee: Robert Bosch GMBH, St ( * ) Notice: Subject to any disclaimer, the term of this patent is extended or adjusted under 35 U.S.C. 154(b) by 97 days.

(21) Appl. No.: 14/705,060

(22) Filed: May 6, 2015

(65) Prior Publication Data

US 2015/0322880 A1 Nov. 12, 2015

(30) Foreign Application Priority Data

May 9, 2014 (DE) ..... 10 2014 208 731

(51) Int. Cl.
*F02D 41/34* (2006.01)
*F02D 41/14* (2006.01)
(Continued)

(52) U.S. Cl.
CPC ..... *F02D 41/2458* (2013.01); *F02D 41/04* (2013.01); *F02D 41/1495* (2013.01);
(Continued)

(58) Field of Classification Search
CPC ..... F02D 41/0085; F02D 41/1454; F02D 41/1456; F02D 41/2454; F02D 41/1495; F02D 41/008; Y02T 10/47
See application file for complete search history.

(56) References Cited

U.S. PATENT DOCUMENTS

2011/0288739 A1* 11/2011 Kidokoro ..... F02D 41/0085 701/99
2013/0060449 A1* 3/2013 Bagnasco ..... F02D 41/0085 701/103

(Continued)

OTHER PUBLICATIONS

"Sensoren im Kraftfahrzeug [Sensors in a Motor Vehicle]" Konrad Reif, Springer-Vieweg 2. Edition, 2012, pp. 160-165.*.

*Primary Examiner* — Sizo Vilakazi
(74) *Attorney, Agent, or Firm* — Norton Rose Fulbright US LLP; Gerard Messina

(57) ABSTRACT

A method for determining an imbalance of at least one cylinder in an arrangement of at least two cylinders in a system is provided, which includes an internal combustion engine, the imbalance of the at least one cylinder being present in relation to at least one property of an exhaust gas of the internal combustion engine and the determination of the imbalance of the at least one cylinder occurring with a sensor device for detecting at least one property of the exhaust gas of the internal combustion engine. A diagnostic threshold is ascertained through a dynamic characterization of the system with the sensor device, the dynamic characterization taking place after an excitation of the system. The diagnostic threshold makes it possible to delimit a range of potential erroneous detections which are caused due to a dispersion of an evaluating signal resulting from the imbalance of the at least one cylinder.

15 Claims, 3 Drawing Sheets

(51) Int. Cl.
*F02D 41/24* (2006.01)
*F02D 41/04* (2006.01)
*F02D 41/28* (2006.01)

(52) U.S. Cl.
CPC ..... *F02D 41/34* (2013.01); *F02D 2041/1423* (2013.01); *F02D 2041/288* (2013.01)

(56) References Cited

U.S. PATENT DOCUMENTS

2013/0073184 A1* 3/2013 Miyamoto ..... F02D 41/0085
701/104
2013/0253802 A1* 9/2013 Miyamoto ..... F02D 43/04
701/103

* cited by examiner

METHOD FOR DETERMINING AN IMBALANCE OF AT LEAST ONE CYLINDER

CROSS REFERENCE TO RELATED APPLICATION

The present application claims priority to Application No. DE 10 2014 208 731.7, filed in the Federal Republic of Germany on May 9, 2014, which is incorporated herein in its entirety by reference thereto.

FIELD OF INVENTION

The present invention relates to a method for determining an imbalance of at least one cylinder.

BACKGROUND INFORMATION

On board diagnostic (OBD) devices in vehicles are known from the related art. With the aid of OBD, components of an internal combustion engine in a vehicle may, in particular, be monitored which have an effect on a property of an exhaust gas of the internal combustion engine. Errors occurring in relation to a property of the exhaust gas are detected by the OBD and displayed to the driver of the motor vehicle via an indicator light, for example, as well as permanently stored in an associated control unit. OBD was first introduced in 1988 by the California Air Resources Board (CARB) against the background that the exhaust gas regulations should not only be complied with at the registration of the motor vehicle, but should also be ensured during its lifetime. Within the scope of the further development of the second generation of the electronic systems for self-monitoring (CARB-OBD II), which is presently in use, a diagnosis of cylinder-selective mixture errors, which are relevant to the exhaust gas, is required, among other things. These types of mixture errors are essentially based on the fact that in an arrangement of at least two cylinders in a system, which includes an internal combustion engine, not necessarily every cylinder is set to the optimum ratio of combustion air and fuel (lambda=1) in the case of which what may be a complete consumption of oxygen from the combustion air takes place in the fuel. This condition of cylinders in the internal combustion engine which occurs in practice is usually referred to as "imbalance."

The determination of the imbalance of at least one cylinder generally takes place with the aid of a sensor device for detecting at least one property of an exhaust gas of the internal combustion engine. Sensor devices of this type, which in particular include lambda sensors, are known from the related art and are described, for example, in Konrad Reif, publisher, Sensoren im Kraftfahrzeug [Sensors in a Motor Vehicle], Springer-Vieweg 2. edition, 2012, pages 160-165. In this case, so-called "two-point lambda sensors" compare the residual oxygen content in the exhaust gas to the oxygen content of a reference gas atmosphere, which may be present in the interior of the sensor device as recirculating air and show whether a rich mixture (Lambda<1) or a lean mixture (Lambda>1) is present in the exhaust gas. Due to its configuration, an abrupt change, which only allows the composition of the mixture to be adjusted to lambda =1, however, occurs at lambda =1 in the characteristics curve of the two-point lambda sensor. In contrast thereto, the oxygen concentration in the exhaust gas may be determined over a wide range with the aid of a "broadband lambda sensor," wherefrom the air/fuel ratio in the combustion chamber of the internal combustion engine may be inferred. The broadband lambda sensor may therefore not only determine the oxygen concentration in the exhaust gas of the internal combustion engine in the stoichiometric point at lambda=1, but also in the lean mixture (Lambda>1) as well as in the rich mixture (Lambda<1). In addition to the speed-based methods, methods are also already known for determining the imbalance of a cylinder which are based on detecting the progression of the lambda value within a combustion cycle of the internal combustion engine. The combustion cycle of the internal combustion engine, which is defined as that period of time during which each of the at least two cylinders has been ignited once, is used to determine from a difference of a maximum lambda value and a minimum lambda value a so-called "peak-to-peak" value which is correlated with the fact of how a cylinder deviates, i.e., is trimmed, from the rest of the cylinders present in the internal combustion engine.

This value may be used to determine with the aid of an evaluation algorithm an evaluating signal which may also be referred to as an "air/fuel imbalance monitoring" (AFIM) signal. With regard to the real imbalance of the cylinders in the internal combustion engine, in practice, the evaluating signal is, however, subject to a dispersion which may result in potential erroneous detections. Keeping the influence variables in the system, which includes the internal combustion engine, which may be constant, generally requires a lot of effort, however. It would therefore be desirable to provide a method for determining an imbalance of at least one cylinder in an arrangement of at least two cylinders in a system which includes an internal combustion engine, this method may largely delimit the range of potential erroneous detections due to the dispersion of the real imbalance of the cylinders.

SUMMARY OF THE INVENTION

Therefore, a method is provided for determining an imbalance of at least one cylinder in an arrangement of at least two cylinders in a system, which includes an internal combustion engine, this method may largely prevent the range of potential erroneous detections due to the dispersion of the real imbalance of at least one cylinder in the arrangement of at least two cylinders in the system.

In an internal combustion engine, chemical energy which is made available by a fuel introduced into a combustion chamber is converted by combustion into mechanical work which is, in particular, used for driving the motor vehicle. In particular, the internal combustion engine has at least two cylinders for the purpose of compressing an ignitable gas mixture made of fuel and ambient air. As already described above, in the event of an error, real cylinders show an imbalance which results in that in a single cylinder the combustion does not take place at the predefined setpoint value, e.g., not at the stoichiometric point at lambda=1, but rather in the lean range (Lambda>1) or in the rich range (Lambda<1). As already explained above, an evaluating signal which is subject to a dispersion with regard to the real imbalance of the cylinders present in the system may be ascertained by determining the imbalance of at least one cylinder in an arrangement of at least two cylinders in a system. A manufacturing tolerance of the lambda sensor used as well as a dependence on the installation angle position of the lambda sensor is incorporated, among other things, into the dispersion of the evaluating signal.

In order to delimit the potential range of erroneous detections, a diagnostic threshold is introduced according to the present invention into the method for determining the imbalance of at least one cylinder in an arrangement of at least two cylinders in a system, which includes an internal combustion engine, in such a way that also in that case in which in the event of a constellation of the influence variables which result in an excessively low evaluating signal an error is indicated only above the maximally admissible imbalance of the cylinder, while in the case in which in the event of a constellation of the influence variables which result in an excessively high evaluating signal an error is only indicated when the maximally admissible imbalance has already in fact been exceeded. The introduction of the diagnostic threshold according to the present invention accordingly largely ensures that, regardless of the dispersion of the detected evaluating signal, the actual value of the imbalance of the at least one cylinder is detected in relation to at least one property of the exhaust gas of the internal combustion engine, in particular the oxygen content of the exhaust gas.

According to the present invention, the diagnostic threshold which applies to the system in question is ascertained with the aid of the sensor device for detecting at least one property of the exhaust gas of the internal combustion engine, in particular of the oxygen content of the exhaust gas, by carrying out a dynamic characterization of the system, the dynamic characterization of the system taking place after an excitation of the system has taken place. In this case, a "dynamic" of the system is, in particular, understood to mean the runtime performance of the system, which includes the internal combustion engine, and in which the arrangement of at least two cylinders is situated. According to the present invention, the sensor device is used to characterize the dynamic of the system, i.e., which may be to detect at least one parameter which is characteristic for the present dynamic, i.e., the corresponding runtime performance, of the system. In this way, the diagnostic threshold may, in particular, take into consideration a non-constant dynamic of the system which may be attributed to the sensors, the system and/or the installation-specific variations, for example, from which a dispersion of the evaluating signal may result.

According to the present invention, the dynamic characterization of the system takes place after an excitation of the system, an "excitation" of the system being understood to mean an external involvement in the system, e.g., with the aid of an impulse and/or a stimulus acting thereon, which may influence the system, at least one property of the exhaust gas, which may be the oxygen content of the exhaust gas, which is indicated, in particular, in the form of a lambda value, being influenceable by the excitation of the system within the scope of the present invention. The excitation of the system may in this case take place gradually or also abruptly, whereby a response, which may also be referred to as a "system response" and, in particular in the case of an abrupt excitation, it may also be referred to as an "abrupt response," to the excitation is caused in the system, the system response, which may be at a working point of the system, being useable for the purpose of dynamic characterization.

In one embodiment, the excitation of the system takes place abruptly and for the purpose of dynamic characterization of the system, an abrupt response of the system is used, which may be detected with the aid of the sensor device at least one rise time of the abrupt response to the abrupt excitation may be used as the at least one parameter for dynamic characterization. Alternatively or additionally, a down time, i.e., the time duration between the excitation of the system, which took place abruptly, and the abrupt response of the system resulting therefrom, may be used as the at least one parameter for dynamic characterization. Further parameters for dynamic characterization are conceivable from the abrupt response of the system which may be detected with the aid of the sensor device.

In one embodiment, the excitation of the system may, in particular, take place through a variation of an injection quantity of fuel into the system, which includes the internal combustion engine, whereby the lambda value detected with the aid of the sensor device changes in the exhaust gas of the internal combustion engine. Here, the variation of the injection quantity of fuel may take place gradually or abruptly in that a so-called "forced amplitude" is applied to the internal combustion engine, for example, with the aid of which the system may be alternatingly set to a combustion at a lambda value above 1.0 (lean phase) and a lambda value below 1.0 (rich phase) in such a way that a medium lambda value which may be close to lambda=1 in particular results over a longer period of time. The storage capacity of the catalytic converter does, however, not necessarily result in a worsening of the exhaust gas.

In one embodiment, the ascertainment of the diagnostic threshold takes place by comparing at least one parameter of the dynamic characterization with at least one predefined value. Here, the predefined value may be retrieved from a characteristics map and/or computed with the aid of a function. The diagnostic threshold ascertained in this way may be largely adapted in the system to the real imbalance of the cylinder in question and thus prevents potential erroneous detections. A "characteristics map" is in this case understood to mean one or multiple characteristic curves as a graphic representation of two physical variables which are dependent on one another, are characteristic for the present system and which may be approximated by one or multiple mathematical functions. Depending on the embodiment of the present method, it may be advantageous in this case to carry out the comparison by retrieving a numerical characteristic value from a table or a diagram or by carrying out a numerical computation with the aid of a mathematical function.

Broadband lambda sensors which, as described above, are operated at a lambda value≠1 demonstrate in the case of a gas exchange through lambda=1 a non-monotone output signal which may also be referred to as "lambda 1 ripple" (see also FIG. 4). If an individual cylinder in the system demonstrates an imbalance at lambda>1 (lean imbalance), the other cylinders are trimmed toward lambda<1 (rich imbalance) due to the regulation that the exhaust gas in the system is supposed to return overall to a mean value which may be close to lambda=1. If, however, an individual cylinder is trimmed toward lambda<1 (rich imbalance), the other cylinders are trimmed accordingly toward lean due to the same regulation and therefore have a lambda>1. Regardless of the actually occurring imbalance of a cylinder, a sequence of the evaluating signal therefore always takes place at lambda=1, whereby the intensity of the evaluating signal always increases with the intensity of the lambda 1 ripple in the case of the lambda-based detection of the recognition of an imbalance. Since the lambda 1 ripple is moreover subject to a manufacturing-induced as well as an aging-induced tolerance, a further dispersion of the evaluating signal with regard to the real imbalance of the at least one cylinder may result therefrom.

In one particular embodiment, it is therefore provided to not set the lambda value, at which a determination of the imbalance of the at least one cylinder takes place, to a lambda value≠1.0, but to carry out the determination of the imbalance of the at least one cylinder in particular outside of the range in which the lambda 1 ripple occurs, i.e., in the rich range or in the lean range. For this purpose, the lambda value, at which the determination of the imbalance of the at least one cylinder takes place, may be set to a value of at least 0.9, which may be of at least 0.95, or at a value of maximally 1.10, which may be maximally 1.05.

In one particular embodiment, it may therefore be meaningful to set the chronological progression of the lambda value with the aid of the forced amplitude already described above, in the case of which a short lean phase is followed by a rich phase and vice versa, in such a way that the system, which includes the internal combustion engine, is operated overall at a lambda value which may be close to lambda=1. Accordingly, a first period during which the lambda value is set to a first value below 1.0 is followed by a second period during which the lambda value is set to a second value above 1.0. Alternatively, a first period during which the lambda value is set to a first value above 1.0 (lean range) is followed in this case by a second period during which the lambda value is set to a second value below 1.0 (rich range). In one particular embodiment, the second period is followed in this case by an interval during which the lambda value is set to a value of 1.0, the interval being followed by the first period. Here, the interval has, in particular, a duration which exceeds the duration of the first period and/or of the second period, the duration of the first period and/or of the second period particularly being maximally 3 seconds, particularly being maximally 1 second. By introducing the forced amplitude, it may thus be achieved that a cylinder having a lambda<1 may have a higher evaluating signal in the rich gas phase than in the lean phase due to the lambda 1 ripple. Now, if the evaluating signals from the two phases are ascertained and compared to one another, it may be established in what direction the imbalance of the cylinder in question prevails. Moreover, a potential erroneous detection may be prevented in this case by selecting a smaller value as the diagnostic threshold. In one particular embodiment, it may be advantageous to not activate the forced amplitude during the normal operation of the internal combustion engine, but to carry out the forced amplitude merely for a diagnosis of its functionality at previously selected or accidentally ascertained times.

In another embodiment of the present method, the sensor device may include at least one device for filtering an evaluating signal resulting from the imbalance of the at least one cylinder in the arrangement of at least two cylinders, the device being employable for filtering at least one harmonic wave of the evaluating signal and/or of an interference signal which may occur in the system, which includes an internal combustion engine. In this case, the at least one device for filtering may be used, in particular, to also take into consideration additional sources which may contribute to a dispersion of the evaluating signal with regard to the real imbalance of the at least one cylinder. This primarily includes dispersions of the evaluating signal which may occur, on the one hand, due to the so-called "heater coupling" (HEK) and, on the other hand, due to the so-called "dynamic pressure dependence" (DDA).

The sensor device which may, in particular, be configured in the form of a lambda sensor usually includes a heating element which is typically acted on by a voltage which is provided with a pulse width modulation (PWM). Depending on the selected sensor type, an incident inflow of the gas flow to the sensor element as well as as a function of the temperature in the sensor element, the frequency of the pulse-width-modulated voltage may couple into the sensor device so that the frequency of the pulse width modulation, which is typically at 100 Hz in a common motor vehicle, may be detected in the evaluating signal in the form of an interference signal superimposing the evaluating signal.

The dynamic pressure dependence is generally a function of an amplitude and a frequency of the external pressure acting on the sensor device. In the case of a four-cylinder engine without a cylinder cutoff, the frequency of the dynamic pressure dependence is typically twice the speed of the vehicle engine.

Moreover, the evaluating signal resulting from the imbalance of an individual cylinder may also have a harmonic wave spectrum itself. As described above, in the case of a four-cylinder engine, the evaluating signal resulting from the imbalance of an individual cylinder is half of the speed of the engine plus the harmonic waves which occur in particular at the engine speed, at 3/2 of the engine speed, etc. The harmonic waves may, in particular, result from the progression of the rotation of the engine which is not exactly sinus-shaped in practice. Moreover, a simultaneous imbalance of two cylinders which are not ignited consecutively may also have a negative effect on the spectral component of the engine speed. One example of the spectral components of the evaluating signal may be found below in FIG. 5.

In one particular embodiment, the device for filtering the evaluating signal may include at least one analog filter, at least one digital filter and/or a combination of at least one analog filter and at least one digital filter. According to the present invention, an analog filter of the first order is suitable, in particular, which has a time constant of 3 ms and which may be combined with a digital moving time averager over a period of 10 ms. Moreover, other filters are, however, also employable, e.g., a low-pass filter, a bandpass filter and/or a band elimination filter of the first or also higher order.

Alternatively or additionally to the described filtering of the evaluating signal with the aid of at least one analog filter, at least one digital filter and/or a combination of the two, a device may also be used for evaluating the spectral components contained in the evaluating signal. For this purpose, a Fourier transform, a discrete Fourier transform, or a fast Fourier transform are suitable, for example. Alternatively or additionally, the spectral components may be ascertained based on an algorithm suitable for this purpose, such as the Goertzel algorithm. Here, a selection of the spectral components which are relevant for the evaluating signal may be carried out; the engine speed is particularly suitable for this purpose since, as described above, the evaluating signal, in particular, has spectral components at half of the engine speed, at the engine speed, at 3/2 of the engine speed, and, potentially, at further harmonic waves of the engine speed. In this context, the harmonic waves may be observed separately, added, added square, or subjected to another operation, in particular also to be able to recognize a simultaneous imbalance of two cylinders which are not ignited consecutively. In this case, it may be advantageous to note that an imbalance of this type may, for dynamics reasons, have only an attenuated effect on the spectral components at the engine speed and compensate for this effect in the evaluation of the spectral components. Here, a simultaneous imbalance of two cylinders which are not ignited consecutively may be recognized, in particular, by comparing the spectral components at half of engine speed U0 and the spectral components at engine speed U1 or by ascertaining ratio U1/U0 achievable thereby. In contrast, an imbalance of two cylinders which are ignited consecutively may only be recognized through a change in the signal form in the above-mentioned harmonic waves.

The present invention has a series of advantages in relation to the determination of the imbalance of at least one cylinder in an arrangement of at least two cylinders in a system, which includes an internal combustion engine. The introduction of the diagnostic threshold provided according to the present invention results in that an error is displayed only starting from the maximally admissible imbalance of the cylinder within the scope of an engine diagnosis even in the case of a constellation of influence variables which result in an excessively low evaluating signal. At the same time, the diagnostic threshold may be set due to the dynamic characterization of the system according to the present invention in such a way that even in the case of a constellation of the influence variables to the system, which result in an excessively high evaluating signal, an error is only displayed if the maximally admissible imbalance is in fact exceeded. In this way, it is possible despite the dispersion of the evaluating signal to considerably delimit the range of potential erroneous detections due to the real imbalance of the at least one cylinder.

Exemplary embodiments of the present invention are illustrated in the figures and explained in greater detail in the following description.

DETAILED DESCRIPTION

Figure 1A:
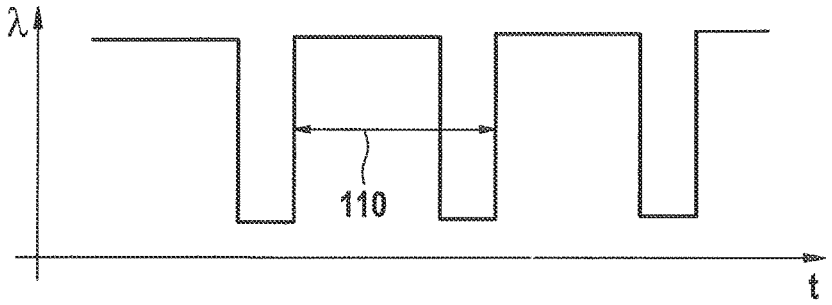
FIGS. 1A and 1B show the chronological progression of the lambda value within multiple operating cycles of an internal combustion engine (a) as well as the evaluating signal which is detected therefrom with the aid of a sensor device and ascertained with the aid of an algorithm (b).
Figure 1B:
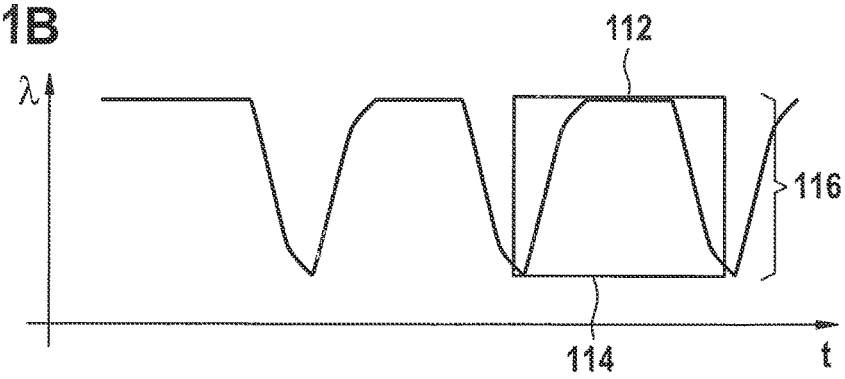

FIG. 1*a*) shows the chronological progression of the lambda value within multiple operating cycles 110 of an internal combustion engine, while in FIG. 1*b*), the chronological progression of the lambda value is illustrated in the way in which it is recorded by the sensor device for detecting at least one property of the exhaust gas of the internal combustion engine. An evaluating signal 116, which may also be referred to as an "air/fuel imbalance monitoring" (AFIM) signal, may be ascertained from a difference between a maximum lambda value 112 and a minimum lambda value 114 with the aid of an evaluation algorithm which is suitable therefore.

Figure 2:
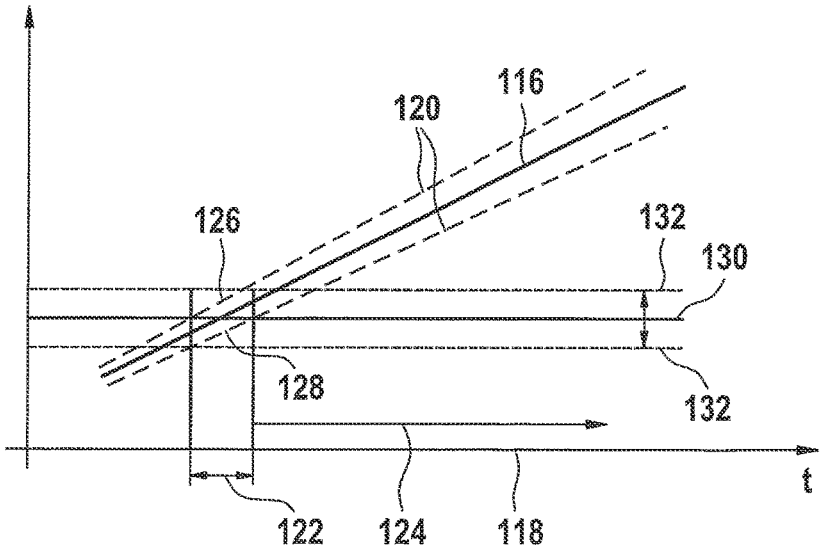
FIG. 2 shows a schematic representation of the evaluating signal as a function of the real imbalance of at least one cylinder in an arrangement of at least two cylinders in a system, which includes an internal combustion engine, a dispersion of the evaluating signal possibly resulting in a potential erroneous detection.

As is apparent from FIG. 2, evaluating signal 116 correlates with how high imbalance 118 of the observed cylinder is in relation to the remaining at least two cylinders in the arrangement in a system, which includes the internal combustion engine. However, evaluating signal 116 is subject to a dispersion 120 with regard to the real imbalance of the observed cylinder. Dispersion 120 results in that an imbalance may only be reliably recognized above a range 122 of potential erroneous detections, i.e., in a range 124 of the reliable recognition, whereas a potential erroneous detection may occur if evaluating signal 116 is subject to dispersion 120 in range 122.

Here, in the case of a constellation of influence variables on evaluating signal 116, which result in an excessively high evaluating signal 126, a fixed diagnostic threshold 130 may already be exceeded in range 122 of the potential erroneous detections, although the maximally admissible imbalance of the observed cylinder has not been reached yet. Conversely, in the case of a constellation of influence variables, which result in an excessively low evaluating signal 128, a fixed threshold 130 is not exceeded yet in range 122 of the potential erroneous detections, although the maximally admissible imbalance of the observed cylinder has already been exceeded.

For this reason, it is provided according to the present invention to ascertain a variable diagnostic threshold 132 by a dynamic characterization of the system with the aid of the sensor device according to FIG. 1*b*). According to the present invention, diagnostic threshold 132 is ascertained by comparing at least one parameter of the dynamic characterization with at least one predefined value, whereby an increase or a decrease of diagnostic threshold 132 may result as a function of the dynamic of the observed system. In this way, it may be ensured that a reliable detection of the imbalance of the at least one cylinder is made possible according to the present invention even in range 122 in which in the case of a fixed threshold 130, a potential erroneous detection may occur according to the related art.

Figure 3A:
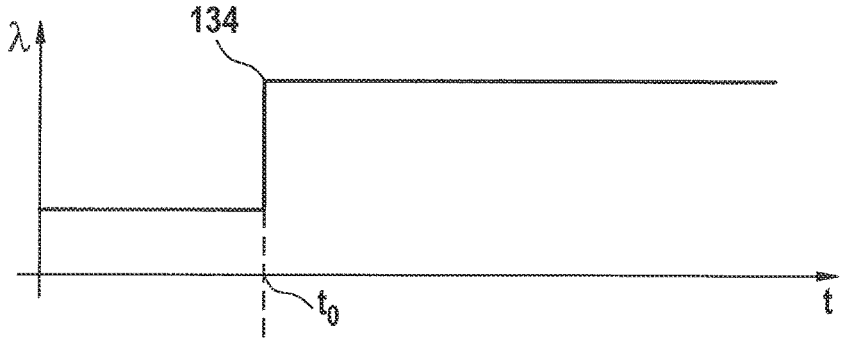
FIGS. 3A and 3B schematically show an abrupt excitation of the system at a point in time t0 (a) and the abrupt response of the sensor device which is used for the dynamic characterization of the system (b).
Figure 3B:
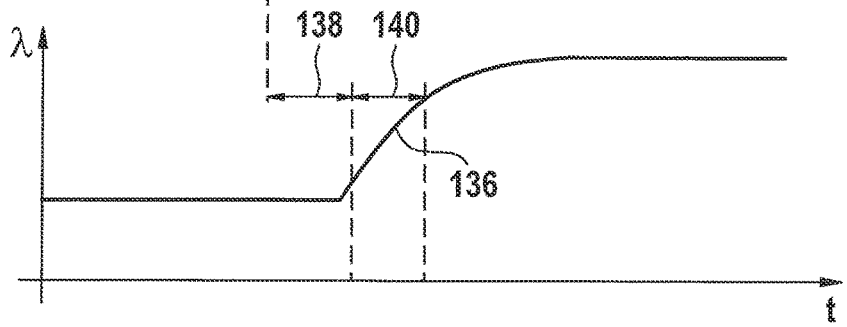

FIG. 3 shows a particular exemplary embodiment for ascertaining the dynamic characterization of the system with the aid of the sensor device. For this purpose, as shown in FIG. 3*a*), an abrupt excitation 134 of the system takes place at point in time t0 with the aid of an external impulse and/or an external stimulus, e.g., by suddenly increasing the injection quantity of fuel into the at least one cylinder. The system, which includes the arrangement of at least two cylinders, responds to this abrupt excitation 134 with the aid of an abrupt response 136 which may be characterized by a down time 138 and a subsequent rise time 140. In particular, down time 138 and/or rise time 140 of abrupt response 136 of the system are suitable parameters for the dynamic characterization. For this purpose, rise time $t_{10\text{-}63}$, i.e., the time within which the differential signal between the maximum lambda value and the minimum lambda value increases from 10% to 63% may be used, for example. Alternatively, a rise time which is different therefrom may be used, e.g., rise time $t_{10\text{-}90}$ which is the time within which the differential signal rises from 10% to 90%. The measured values ascertained therefrom may be compared with at least one predefined value, the predefined value being in particular retrievable from a characteristics map and/or a function. The dynamic characterization of the system ascertained in this way makes possible the determination of diagnostic threshold 132 as a function of the dynamic of the system, whereby range 122 may be considerably delimited by potential erroneous detections.

Figure 4:
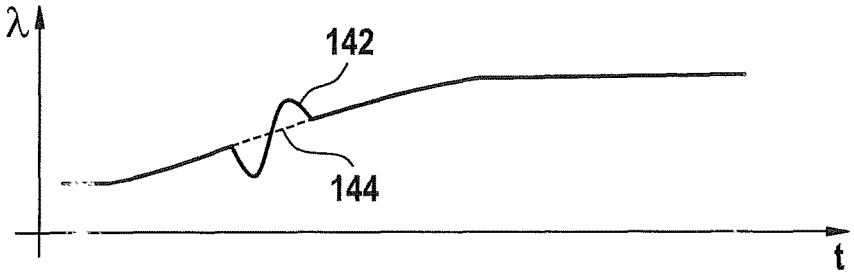
FIG. 4 shows a schematic representation of the abrupt response with and without a lambda 1 ripple.

FIG. 4 schematically illustrates the phenomenon of so-called "lambda 1 ripple" 142 which shows a non-monotone evaluating signal at lambda=1. If however, as is furthermore provided according to the present invention, a diagnosis of the system, which includes the internal combustion engine, is carried out at a lambda value of lambda≠1, a monotone evaluating signal 144 without the lambda 1 ripple is obtained, since a lambda 1 sequence does not take place for a lambda value of lambda≠1.

Figure 5:
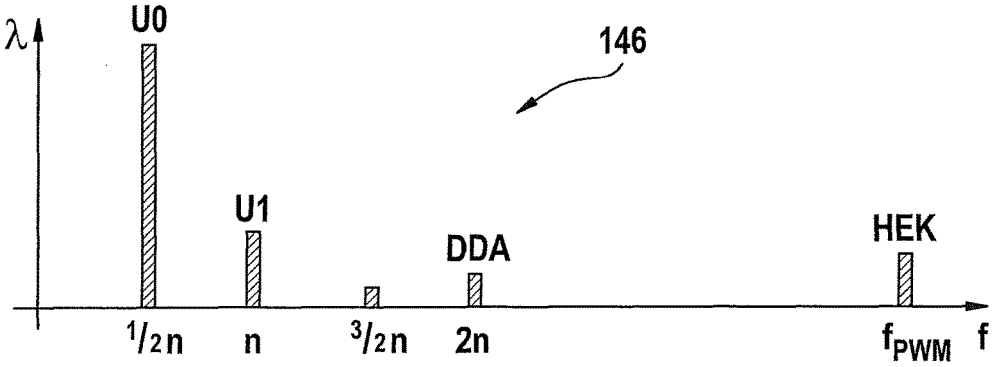
FIG. 5 shows a schematic representation of a typical frequency spectrum of the evaluating signal.

In FIG. 5, a frequency spectrum of the lambda value is schematically illustrated as a function of frequency f. Here, n identifies the engine speed, the following spectral components being typically observable:

at U0, i.e., at half of engine speed 1/2 n, at U1, i.e., at engine speed n, at 3/2 at engine speed 3/2 n, possibly further harmonic waves, the dynamic pressure dependence DDA at twice the engine speed 2n, as well as an interference signal HEK which is caused by the heating element of the lambda sensor which is acted on by a pulse-width-modulated voltage PWM at a frequency $f_{PWM}$.

By using a device for filtering, one or multiple desirable spectral components may be filtered out from frequency spectrum 146 and/or undesirable spectral components are suppressed. Alternatively or additionally, one or multiple spectral components, also desirable spectral components, may be selected or undesirable spectral components may be suppressed with the aid of an algorithm, in particular a Fourier transform, a discrete Fourier transform, a fast Fourier transform and/or a Goertzel algorithm.

What is claimed is:

1. A method for determining an imbalance of at least one cylinder in an arrangement of at least two cylinders in a system having at least one control unit and a sensor device, which includes an internal combustion engine, the method comprising:

determining the imbalance of the at least one cylinder with the sensor device for detecting at least one property of an exhaust gas of the internal combustion engine, the imbalance of the at least one cylinder being present in relation to at least one property of the exhaust gas of the internal combustion engine, the determining the imbalance comprising:

applying an abrupt excitation to the system, wherein the abrupt excitation is a sudden change in an injection quantity of fuel into the system that applies a forced amplitude to the internal combustion engine at a time outside of a normal operation of the internal combustion engine, the abrupt excitation resulting in a dynamic characterization of the system;

setting a chronological progression of a lambda value based on the forced amplitude such that the determined imbalance of the at least one cylinder is determined outside of a range in which a lambda 1 ripple occurs; and ascertaining a variable diagnostic threshold based on the dynamic characterization of the system with the aid of the sensor device, the variable diagnostic threshold varying as a function of the dynamic characterization;

determining that an error is present in the system based on the determined imbalance of the at least one cylinder and the ascertained variable diagnostic threshold; and displaying and/or storing the error via an on board diagnostic system.

2. The method of claim 1, wherein the variable diagnostic threshold is ascertained by comparing at least one parameter of the dynamic characterization with at least one predefined value.

3. The method of claim 1, wherein for the purpose of the dynamic characterization of the system, an abrupt response of the system to the abrupt excitation of the system is used, and wherein at least one rise time of the abrupt response to the abrupt excitation and/or a down time between the abrupt excitation and the abrupt response is used as the at least one parameter.

4. The method of claim 1, wherein the sensor device detects an oxygen content of the exhaust gas, the oxygen content of the exhaust gas being indicated in the form of the lambda value.

5. The method of claim 1, wherein the lambda value, at which the determination of the imbalance of the at least one cylinder takes place, is set unequal to 1.0.

6. The method of claim 1, wherein the lambda value, at which the determination of the imbalance of the at least one cylinder takes place, is set to a value of at least 0.9.

7. The method of claim 1, wherein a first period, during which the lambda value is set to a first value below 1.0, is followed by a second period, during which the lambda value is set to a second value above 1.0, or a first period, during which the lambda value is set to a first value above 1.0, is followed by a second period, during which the lambda value is set to a second value below 1.0.

8. The method of claim 1, wherein the second period is followed by an interval during which the lambda value is set to the value of 1.0, the interval being followed by the first period, the interval having a duration which exceeds the duration of the first period and/or the second period, the duration of the first period and/or of the second period being maximally 3 s.

9. The method of claim 1, wherein the sensor device includes at least one filtering device for detecting and/or suppressing at least one spectral component in a frequency spectrum of an evaluating signal resulting from the imbalance of the at least one cylinder.

10. The method of claim 1, wherein the variable diagnostic threshold is ascertained by comparing at least one parameter of the dynamic characterization with at least one predefined value, wherein the predefined value is retrieved from at least one of a characteristics map and a characteristics function.

11. The method of claim 1, wherein the lambda value, at which the determination of the imbalance of the at least one cylinder takes place, is set to a value of at least 0.95.

12. The method of claim 1, wherein the lambda value, at which the determination of the imbalance of the at least one cylinder takes place, is set to a value of maximally 1.1.

13. The method of claim 1, wherein the lambda value, at which the determination of the imbalance of the at least one cylinder takes place, is set to a value of maximally 1.05.

14. The method of claim 1, wherein the second period is followed by an interval during which the lambda value is set to the value of 1.0, the interval being followed by the first period, the interval having a duration which exceeds the duration of the first period and/or the second period, the duration of the first period and/or of the second period being maximally 1 s.

15. The method of claim 1, further comprising displaying the error via the on board diagnostic system.

* * * * *